US007971841B2

(12) United States Patent
Van Wyk

(10) Patent No.: US 7,971,841 B2
(45) Date of Patent: Jul. 5, 2011

(54) MOTORCYCLE SADDLEBAG WALL HANGER

(76) Inventor: Loren Van Wyk, Pella, IA (US)

( * ) Notice: Subject to any disclaimer, the term of this patent is extended or adjusted under 35 U.S.C. 154(b) by 253 days.

(21) Appl. No.: 12/387,611

(22) Filed: May 5, 2009

(65) Prior Publication Data

US 2010/0282927 A1 Nov. 11, 2010

(51) Int. Cl.
*A47F 5/00* (2006.01)

(52) U.S. Cl. ..... 248/309.1; 248/317; 211/124; 211/123

(58) Field of Classification Search ..... 211/124, 211/123, 49.1, 88, 18, 71.01; 248/309.1, 248/311.2, 317
See application file for complete search history.

(56) References Cited

U.S. PATENT DOCUMENTS

| | | | | |
|---|---|---|---|---|
| 1,171,198 | A | 2/1916 | Hellberg | |
| 1,654,341 | A | 12/1927 | Mendiolagoitia | |
| 1,962,205 | A | 6/1934 | Murray | |
| 2,091,599 | A | 8/1937 | Larson | |
| 2,482,003 | A | 9/1949 | Kauffman | |
| 2,525,259 | A | 10/1950 | Fenzel | |
| 2,633,998 | A | 4/1953 | Derman | |
| 2,647,641 | A | 8/1953 | Tritt | |
| 2,827,555 | A | 3/1958 | Woolley | |
| 3,907,119 | A * | 9/1975 | Franz | 211/59.4 |
| 3,915,308 | A * | 10/1975 | Ratzloff et al. | 211/70.6 |
| 4,854,456 | A | 8/1989 | Lee | |
| 4,936,467 | A | 6/1990 | Bobeczko | |
| D309,998 | S | 8/1990 | Sumrell | |
| 5,228,578 | A | 7/1993 | Wu | |
| 5,294,006 | A * | 3/1994 | Deschino | 211/18 |
| 5,584,400 | A | 12/1996 | Feinbloom | |
| 5,711,435 | A | 1/1998 | Morison | |
| 5,871,105 | A | 2/1999 | Whitehead | |
| 6,112,909 | A | 9/2000 | Moseley | |
| D431,954 | S | 10/2000 | White | |
| D439,465 | S | 3/2001 | Mok | |
| 6,257,425 | B1 | 7/2001 | Liu | |
| D450,199 | S | 11/2001 | White | |
| 6,561,364 | B1 | 5/2003 | Brunsden | |
| 6,679,537 | B1 | 1/2004 | Putnam, Jr. | |
| 6,808,219 | B2 | 10/2004 | Barber | |
| 6,820,756 | B2 | 11/2004 | Garza | |
| 6,892,992 | B2 | 5/2005 | Donahue | |
| 7,150,364 | B2 | 12/2006 | Jablow | |
| 7,168,577 | B1 | 1/2007 | Moseley | |
| 7,490,803 | B1 | 2/2009 | Graves | |
| 2003/0052031 | A1 | 3/2003 | Poore | |
| 2003/0192843 | A1 | 10/2003 | Winig | |
| 2003/0218109 | A1 | 11/2003 | Farnham | |
| 2004/0108287 | A1 | 6/2004 | Winig | |
| 2004/0124161 | A1 | 7/2004 | Lau | |
| 2004/0124165 | A1 | 7/2004 | Miller | |
| 2005/0045573 | A1 | 3/2005 | Winig | |
| 2007/0080125 | A1 | 4/2007 | Fratantoni | |

* cited by examiner

*Primary Examiner* — Amy J. Sterling
(74) *Attorney, Agent, or Firm* — Brick Gentry, P.C.; Brian J. Laurenzo; Bradley Thies

(57) ABSTRACT

A motorcycle saddlebag hanger is described which includes a vertically disposed support which is secured to a wall or which may be free standing. The hanger includes two identical structures formed thereon for supporting a pair of motorcycle saddlebags when the saddlebags have been removed from a motorcycle. The saddlebags are secured to the hanger utilizing the hardware which normally secures the motorcycle saddlebags to the motorcycle. The hanger may also be free standing. Further, the hanger may be a two-component hanger so that the saddlebags may be positioned in either a vertically spaced-apart manner or in a horizontally spaced-apart manner.

24 Claims, 7 Drawing Sheets

MOTORCYCLE SADDLEBAG WALL HANGER

BACKGROUND OF THE INVENTION

1. Field of the Invention

This invention relates to a motorcycle saddlebag wall hanger and more particularly to a motorcycle saddlebag wall hanger which is adapted to support first and second saddlebags thereon in a vertically-spaced apart manner. Even more particularly, this invention relates to a motorcycle saddlebag wall hanger wherein the saddlebags are selectively removably secured to the wall hanger utilizing the hardware which is normally utilized to selectively removably secure the saddlebags to a motorcycle.

2. Description of the Related Art

Many types of motorcycle saddlebags have been provided which are selectively removably secured to a motorcycle so that when the saddlebags are not needed, they may be quickly and easily removed from the motorcycle. A problem exists in that the saddlebags, when removed from the motorcycle, are difficult to store. In many cases, the saddlebags are simply placed into a cupboard or cabinet or are placed in a corner of a garage or the like. If the saddlebags are placed in a cupboard or cabinet, they take up valuable storage space. If the saddlebags are simply placed in a corner of a garage or the like, they may become damaged and will certainly become dirty.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A motorcycle saddlebag wall hanger is described which is adapted to support first and second saddlebags thereon in a vertically spaced-apart manner which each of the saddlebags having an inner wall with a pair of horizontally spaced-apart openings formed therein. The wall hanger of this invention comprises a vertically disposed first support having upper and lower ends with the first support being adapted to be secured to a wall. The first support has an inner side which is positioned adjacent the wall when the first support is attached to the wall. A first elongated, horizontally disposed support member, having upper and lower ends, is secured, intermediate its length, to the first support adjacent the upper end thereof with the first support member having first and second ends. A second elongated, horizontally disposed support member, having first and second ends, is secured, intermediate its length, to the first support below the first support member so as to be vertically spaced from the first support member.

A third elongated, horizontally disposed support member, having first and second ends, is secured, intermediate its length, to the first support below the second support member so as to be vertically spaced from the second support member. A fourth elongated, horizontally disposed support member, having first and second ends, is secured, intermediate its length, to the first support below the third support member so as to be vertically spaced from the third support member.

A fastener retainer or receiver is positioned at each of the first and second ends of each of the first and third support members. The second support member is adapted to support the first saddlebag thereon so that the pair of openings formed in the inner wall of the first saddlebag are aligned with the fastener retainers positioned at the first and second ends of the first support member. A fastener extends outwardly through each of the pair of openings formed in the inner wall of the first saddlebag and which are selectively removably secured to the fastener retainers at the first and second ends of the first support member.

The fourth support member is adapted to support the second saddlebag thereon so that the pair of openings formed in the inner wall of the second saddlebag are aligned with the fastener retainers positioned at the first and second ends of the third support member. A fastener extends outwardly through each of the pair of openings formed in the inner wall of the second saddlebag and which are selectively removably secured to the fastener retainers at the first and second ends of the third support member.

The fasteners and the fastener retainers are the fasteners and fastener retainers used to selectively removably attach the saddlebags to the motorcycle. The fasteners and fastener retainers are the quick release type.

A modified form of the saddlebag is also shown wherein the first support is a two-piece support to provide first and second hangers which may be secured to a wall in a side-by-side relationship.

It is therefore a principal object of the invention to provide a means for hanging first and second saddlebags when the saddlebags have been removed from a motorcycle.

A further object of the invention is to provide a motorcycle saddlebag wall hanger for supporting first and second saddlebags thereon in a vertically spaced-apart manner.

A further object of the invention is to provide a motorcycle saddlebag wall hanger for supporting first and second saddlebags thereon utilizing the hardware which normally secures the saddlebags to a motorcycle.

Yet another object of the invention is to provide a motorcycle saddlebag wall hanger which does not take valuable space when the saddlebags have been removed therefrom.

Still another object of the invention is to provide a motorcycle saddlebag hanger which may be separated so as to provide first and second hanger units for supporting first and second saddlebags thereon respectively in a horizontally spaced-apart manner.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Figure 1:
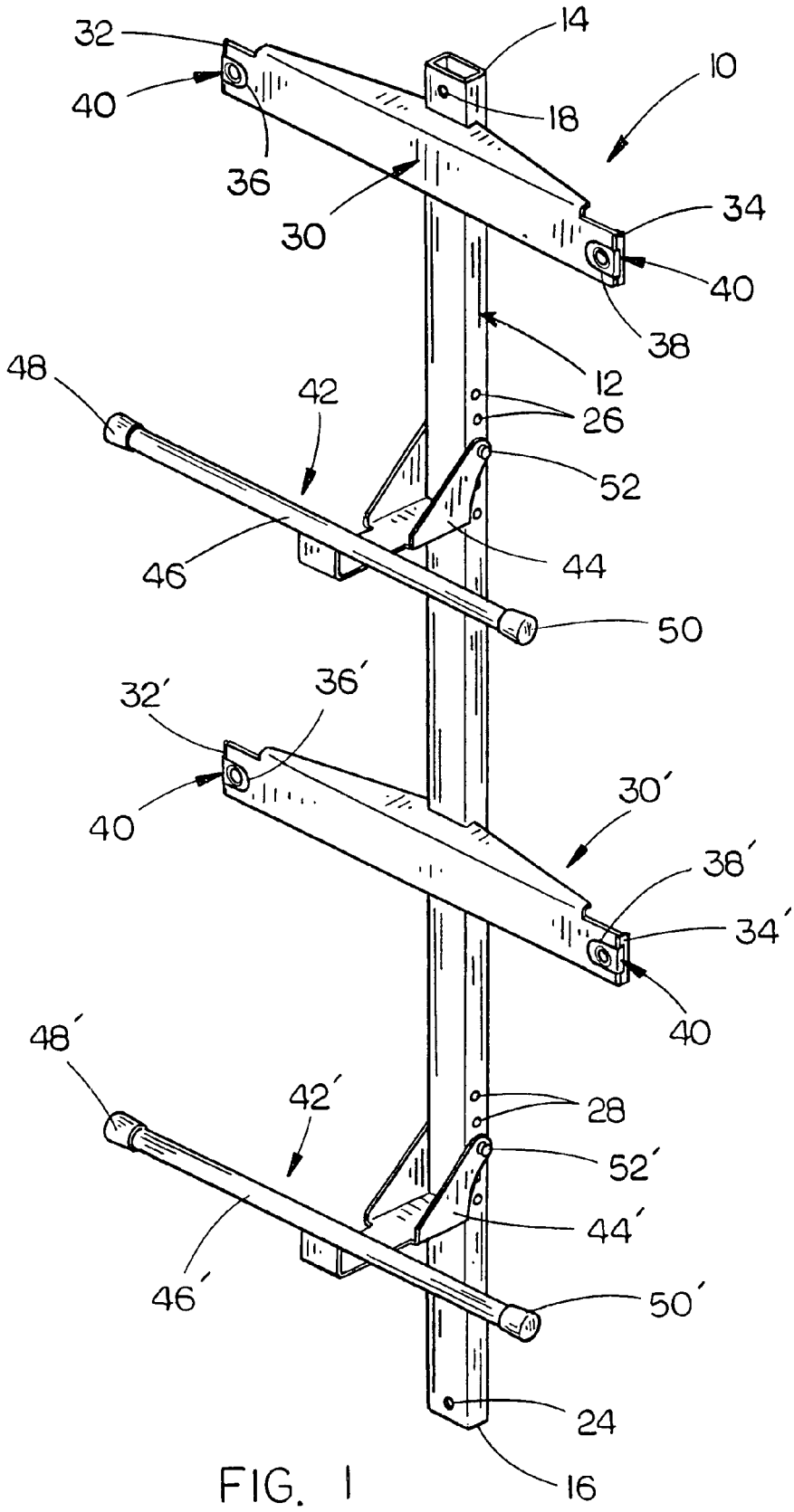
FIG. 1 is a front perspective view of the motorcycle saddlebag wall hanger of this invention.
Figure 4:
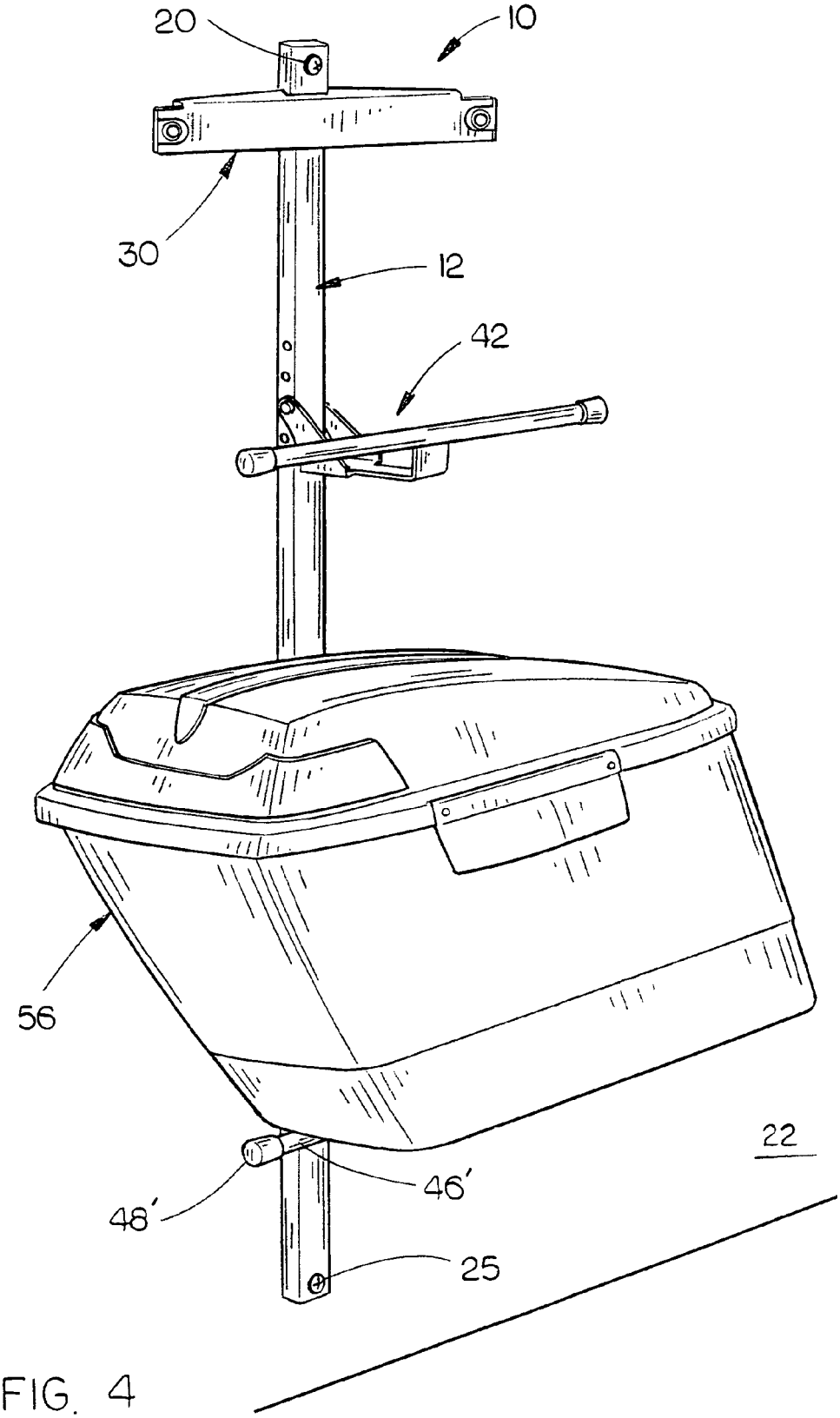
FIG. 4 is a perspective view illustrating a motorcycle saddlebag secured to the wall hanger of this invention.
Figure 5:
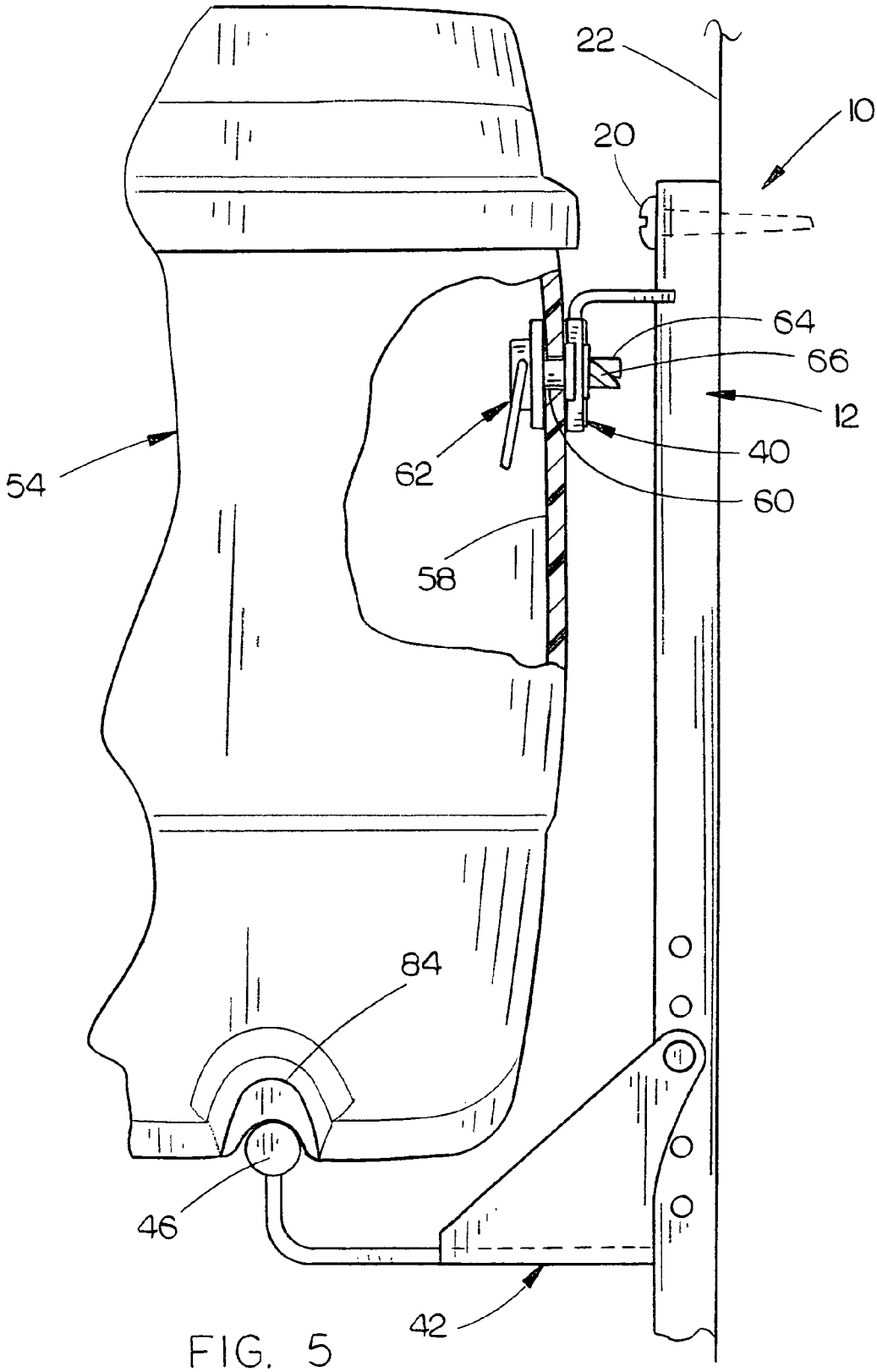
FIG. 5 is a side view of a saddlebag secured to the upper end of the first support with portions of the saddlebag cut away to more fully illustrate the invention.

The numeral 10 refers to the motorcycle saddlebag wall hanger of this invention. Hanger 10 includes a first vertically disposed support 12 having an upper end 14 and a lower end 16. The upper end of support 12 has an opening 18 formed therein adapted to receive a screw 20 extending therethrough so that the support 12 may be secured to a wall 22 or the like (FIGS. 4 and 5). Support 12 is provided with an opening 24 formed therein at the lower end thereof adapted to receive a screw 25 extending therethrough to also secure the support 12 to the wall 22 (FIG. 4). Support 12 is provided with an upper series of openings 26 formed therein and is provided with a lower series of openings 28 formed therein, as seen in FIG. 1.

The numeral 30 refers to a first elongated, horizontally extending support member which is secured to support 12 at the upper end thereof by any convenient means. The ends 32 and 34 of first support member 30 have openings 36 and 38 formed therein respectively. A fastener retainer or receiver 40 is mounted on each of the ends 32 and 34 of first support member 30 so that the central openings thereof are aligned with the openings 36 and 38 respectively.

The numeral 42 refers to a second elongated, horizontally extending support member which includes a bracket 44 and a rod or bar 46 secured to the outer end thereof with the rod or bar 46 having rubber tips 48 and 50 mounted on the opposite ends thereof. Bracket 44 is pivotally secured to support 12 by means of bolt or pin 52 extending therethrough and through one of the openings 26. Pin 52 may be selectively inserted through any of the openings 26 to provide a vertical adjustment of the bracket 44. The pivotal mounting of the bracket 44 to the support 12 enables the support member 42 to be pivotally moved from the supporting position of FIG. 1 to a folded position adjacent the support 12 so that the support member 42 will be stowed closely adjacent the support 12 when not being used.

The numeral 30' refers to a third support member which is positioned below support member 42 and which is identical to support member 30. For purposes of conciseness, the structure on support member 30 which is identical to the structure on support member 30 will be identified with "'". The numeral 42' refers to a fourth support member which is identical to support member 42 and which is positioned below support member 30 as seen in FIG. 1. The structure on support member 42', which is identical to the structure on support member 42, will be indicated with "'".

The numerals 54 and 56 refer to motorcycle saddlebags which are preferably of the hard type constructed of plastic or the like. Saddlebag 54 includes an inner wall 58 having a pair of horizontally spaced-apart openings 60 formed therein. Similarly, saddlebag 56 will have an inner wall with a pair of horizontally spaced-apart openings formed therein. The saddlebags 54 and 56 are normally secured to the motorcycle in a selectively removable fashion by means of fasteners 62 and the fastener retainers or receivers 40. Fastener 62 includes a shank portion 64 having a double cam slot 66 formed therein which extends inwardly into the shank 64 from the end thereof. Fastener 62 includes a head portion 68 and a pivotal handle 70. When the saddlebags are mounted on a motorcycle, a pair of fasteners 62 are extended through the openings 60 in the inner wall of the saddlebag and are connected to the receivers or retainers 40 mounted on the motorcycle in conventional fashion to attach the saddlebags to the motorcycle. The fasteners 62 and the fastener retainers 40 are what is termed a "quick-release" or quarter-turn fastener means.

Figure 2:
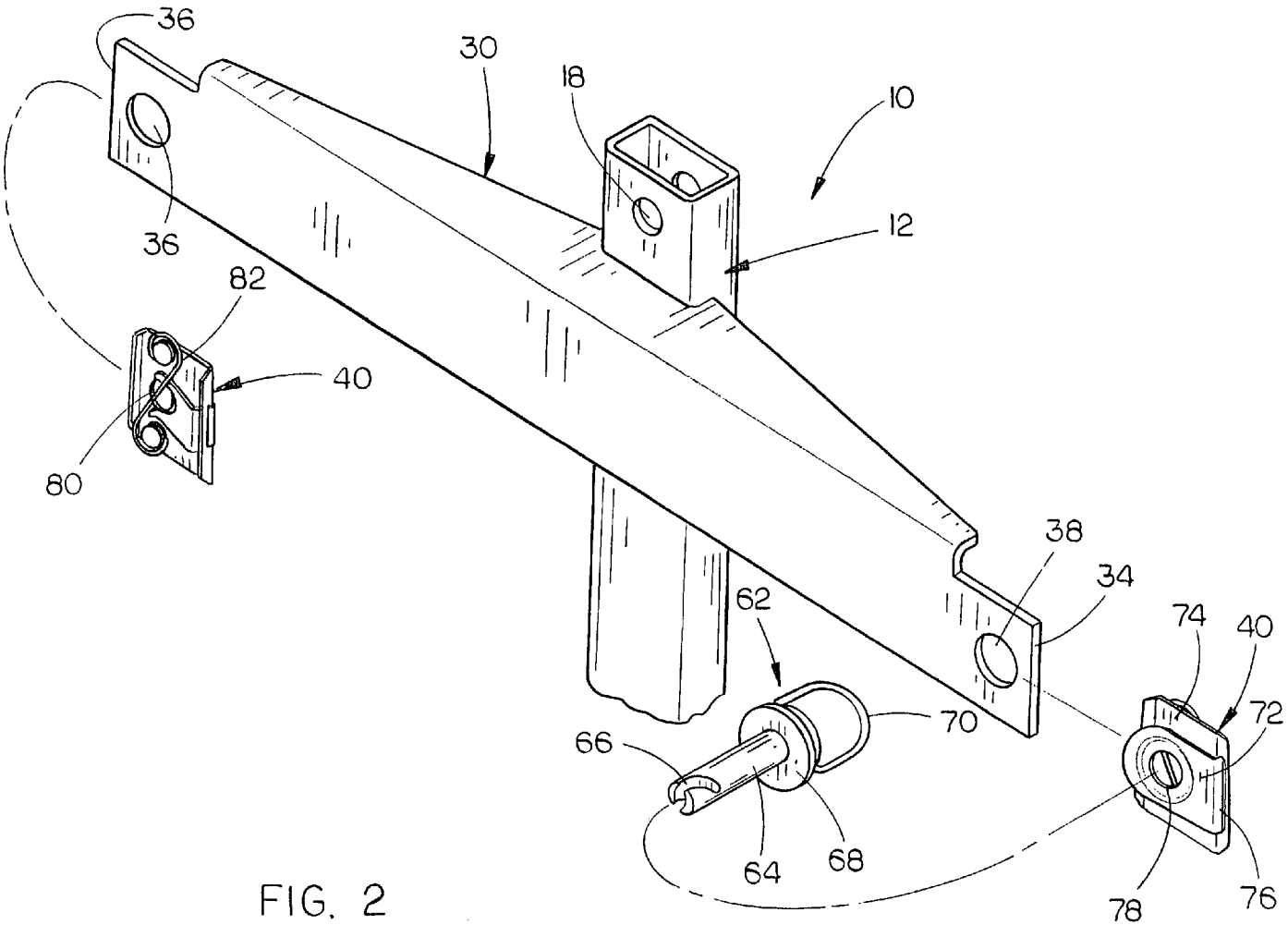
FIG. 2 is an exploded perspective view of the upper end of the first support and the first support member positioned thereon.
Figure 3:
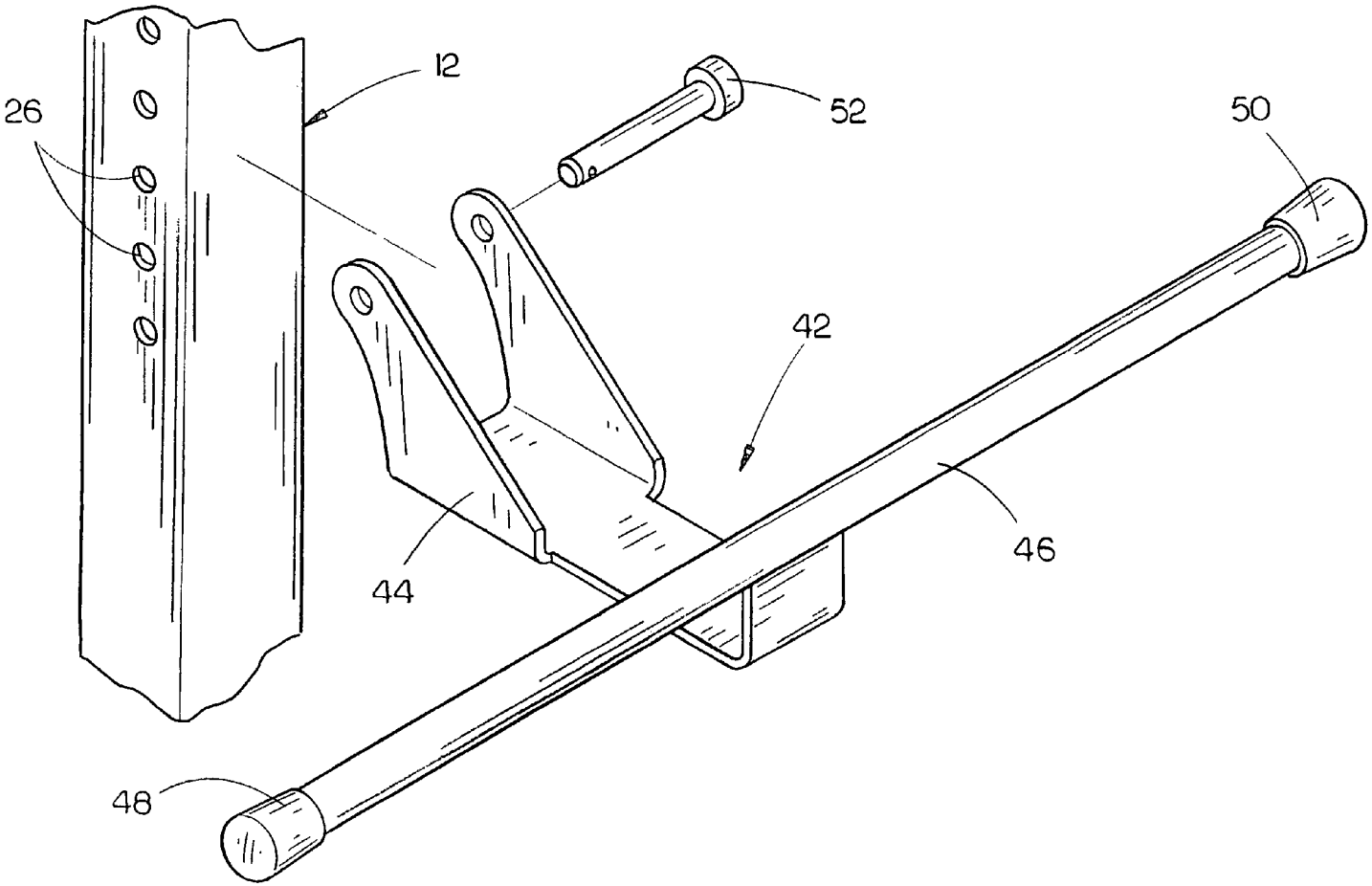
FIG. 3 is a partial exploded perspective view illustrating the manner in which the second support member is selectively vertically adjustably secured to the first support.

Each of the receivers 40 include a U-shaped clip portion 72 at one side of base 74 with the clip portion 72 being joined to the base 74 at 76 to enable the clip portion 72 to be slightly separated from base portion 74 in a frame-like fashion so that the receiver or retainer 40 may be clipped onto the end of the support member 30 with the clip portion 72 being positioned at one side of the support member 30 and the base portion 74 being positioned at the back side of the support member 30. When so positioned, the opening 78 in clip portion 72 registers with an opening 80 formed in base portion 74. As seen in FIG. 2, the back side of the retainer 40 includes a spring-like member 82 which extends across the rearward side of the openings 78 and 80.

The saddlebag 54 is mounted to the wall rack 10 by positioning the inverted U-shaped recess 84 formed in the underside of the saddlebag 54 onto the rod 46 of support member 42, as seen in FIG. 5. The shank of a fastener 62 is then extended through one of the openings 60 formed in the inner wall 58 of saddlebag 54 so that the end of shank 64 may be extended through the opening 78 and 80 of receiver 40 so that the cam slots 66 will register with the spring-like member 82. Rotation of the fastener 62 then causes the fastener 62 to be locked onto the receiver 40. Another fastener 62 is then inserted through the other opening 60 in the inner wall 58 of saddlebag 54 and into the registering receiver 40. Saddlebag 56 will be positioned on the rod 46' and a pair of fasteners 62 will then be extended through the openings formed in the inner wall of saddlebag 56 into the receivers 40 at the ends of the support member 30'.

The saddlebags 54 and 56 may be easily and quickly removed from the wall rack 10 by simply disconnecting the fasteners 60 from the receivers 40. It can therefore be seen that a novel wall rack has been provided which enables a pair of motorcycle saddlebags to be mounted thereon when the saddlebags have been removed from the motorcycle. The wall rack of this invention provides a convenient means for storing the saddlebags without occupying valuable storage space in a cupboard or cabinet. The wall rack of this invention also permits the saddlebags to be secured to the wall rack utilizing the fasteners and fastener retainers normally used to secure the saddlebags to a motorcycle. The wall rack of this invention also enables the saddlebags to be stored in a manner which prevents damage of the same. It can therefore be seen that the invention accomplishes at least all of its stated objectives.

Figure 6:
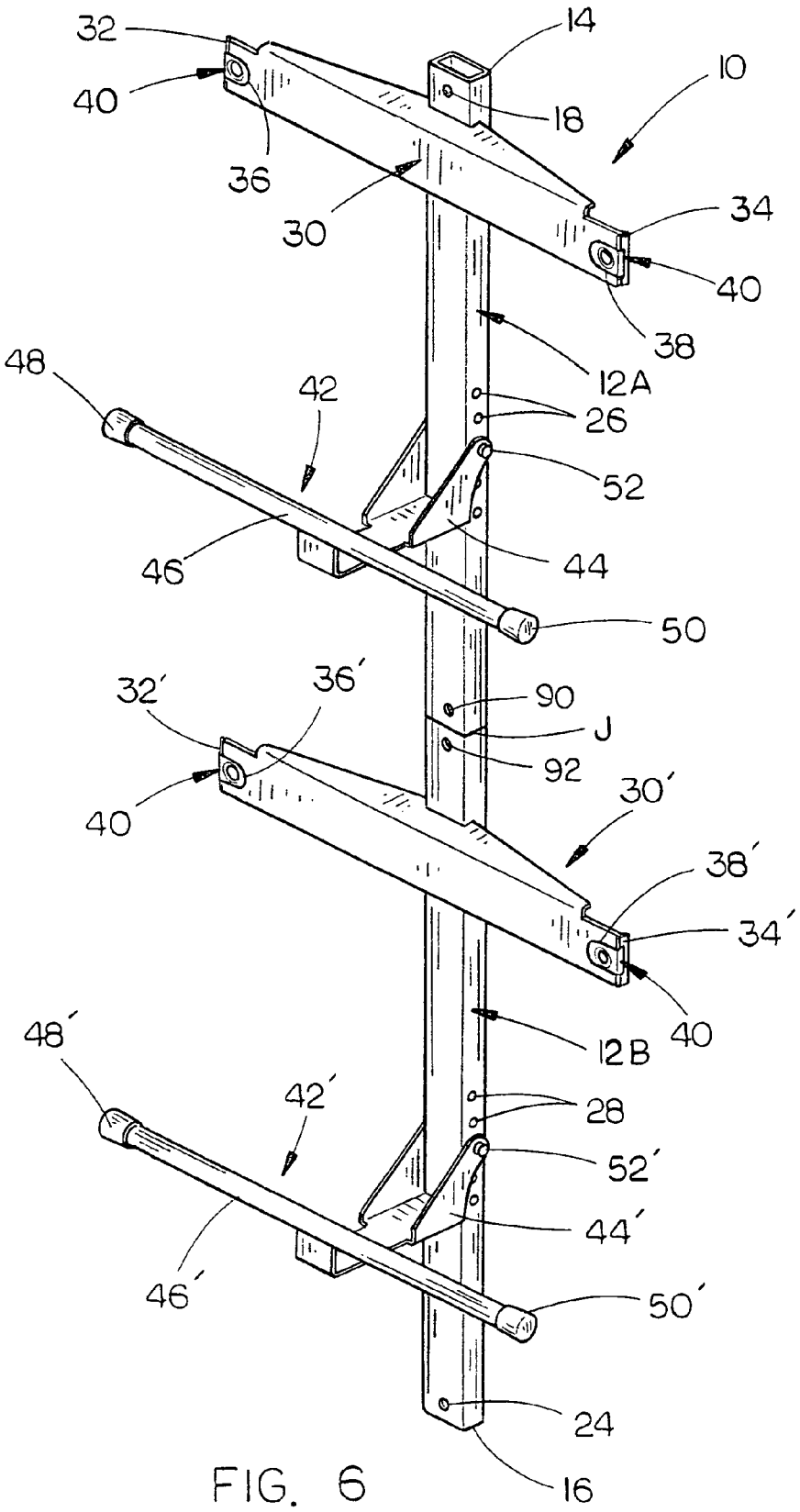
FIG. 6 is a perspective view of a modified form of the invention.
Figure 7:
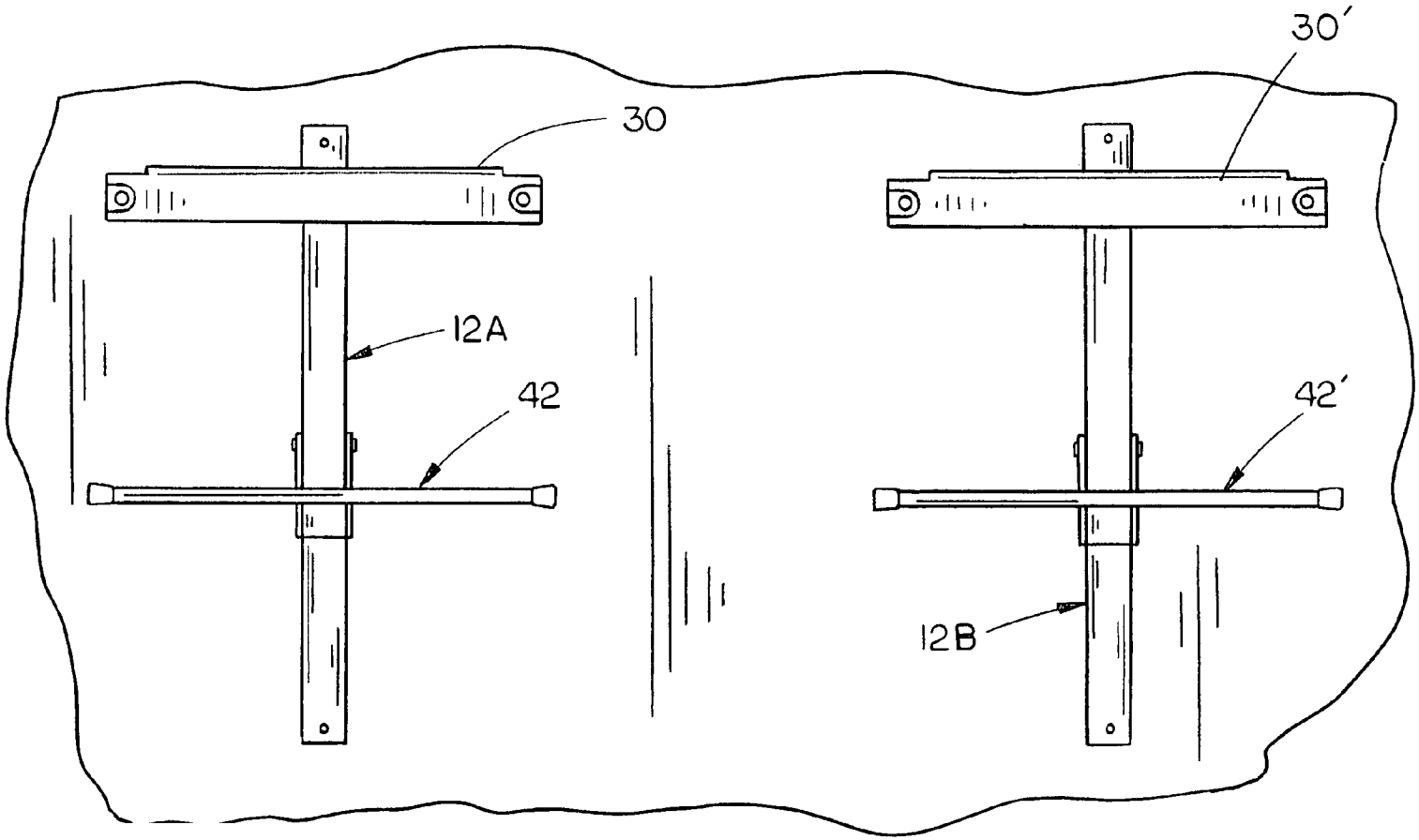
FIG. 7 is a front view illustrating the embodiment of FIG. 6 separated into two hangers and being secured to a wall member.

FIGS. 6 and 7 illustrate a modified form of the saddlebag hanger of this invention which is designated by the reference numeral 10'. Hanger 10' and the components thereon are identical to hanger 10 except that the support 12 is a two-piece support rather than a one-piece support. The support 12 is separated at "J" to provide supports 12A and 12B. The lower end of support 12A has an opening 90 formed therein and the upper end of support 12B has an opening 92 formed therein. The hanger 10' may be secured to a wall in the manner shown in FIG. 6 with screws extending through openings 18, 90, 92 and 24 so that the saddlebags may be supported thereon in an identical manner to that previously described.

If the hanger 10' is to be positioned in a free-standing manner with the saddlebags being supported thereon in a vertically spaced-apart manner, a clamp or connector will be utilized to secure the upper end of support 12B to the lower end of support 12A and with the lower end of support 12B having some sort of base or support thereon to enable the hanger to be supported on a floor or the like.

The hanger 10' may be separated into two hanger units such as seen in FIG. 7 and fastened to a wall or the like to enable the saddlebags to be positioned in a side-by-side manner with screws extending through the openings 18, 90, 92 and 24.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

The invention claimed is:

1. A motorcycle saddlebag wall hanger for supporting first and second saddlebags thereon in a vertically spaced-apart manner with each of the saddlebags having an inner wall with a pair of horizontally spaced-apart openings formed therein, comprising:

a vertically disposed first support having upper and lower ends adapted to be attached to a wall;

said first support having inner and outer sides with said inner side thereof being positioned adjacent the wall when said first support is attached to the wall;

a first elongated, horizontally disposed support member secured, intermediate its length, to said first support adjacent said upper end thereof;

said first support member having first and second ends;

a second elongated, horizontally disposed support member secured, intermediate its length, to said first support below said first support member so as to be vertically spaced from said first support member;

said second support member having first and second ends;

a third elongated, horizontally disposed support member secured, intermediate its length, to said first support below said second support member so as to be vertically spaced from said second support member;

said third support member having first and second ends;

a fourth elongated, horizontally disposed support member secured, intermediate its length, to said first support below said third support member so as to be vertically spaced from said third support member;

said fourth support member having first and second ends;

a fastener retainer positioned at each of said first and second ends of each of said first and third support members;

said second support member adapted to support the first saddlebag thereon so that the pair of openings formed in the inner wall of the first saddlebag are aligned with said fastener retainers positioned at said first and second ends of said first support member;

a fastener extending outwardly through each of the pair of openings formed in the inner-wall of the first saddlebag which are selectively removably secured to the fastener retainers at said first and second ends of said first support member;

said fourth support member adapted to support the second saddlebag thereon so that the pair of openings formed in the inner wall, of the second saddlebag are aligned with said fastener retainers positioned at said first and second ends of said third support member; and a fastener extending outwardly through each of the pair of openings formed in the inner wall of the second saddlebag which are selectively removably secured to the fastener retainers at said first and second ends of said third support member.

2. The saddlebag wall hanger of claim 1 wherein the fasteners and fastener retainers are of the quick release type.

3. The saddlebag wall hanger of claim 2 wherein the fasteners and fastener retainers are of the type used to secure the saddlebags to a motorcycle.

4. The saddlebag wall hanger of claim 1 wherein said second and fourth support members dwell in a vertical plane outwardly of the vertical plane of said first and third support members.

5. The saddlebag wall hanger of claim 1 wherein each of said second and fourth support members are selectively vertically adjustably secured to said first support.

6. The saddlebag wall hanger of claim 4 wherein each of said second and fourth support members are selectively movable between a saddlebag supporting position and a stowed position.

7. A motorcycle saddlebag wall hanger for supporting first and second saddlebags thereon in a vertically spaced-apart manner with each of the saddlebags having an inner wall with a pair of horizontally spaced-apart openings formed therein, comprising:

a vertically disposed first support having upper and lower ends adapted to be attached to a wall;

said first support having inner and outer sides with said inner side thereof being positioned adjacent the wall when said first support is attached to the wall;

a first elongated, horizontally disposed support member secured, intermediate its length, to said first support adjacent said upper end thereof;

said first support member having first and second ends;

a second elongated, horizontally disposed support member secured, intermediate its length, to said first support below said first support member so as to be vertically spaced from said first support member;

said second support member having first and second ends;

a third elongated, horizontally disposed support member secured, intermediate its length, to said first support below said second support member so as to be vertically spaced from said second support member;

said third support member having first and second sides;

a fourth elongated, horizontally disposed support member secured, intermediate its length, to said first support below said third support member so as to be vertically spaced from said third support member;

said fourth support member having first and second ends;

each of said first and second ends of said first and third support members having an opening formed therein;

said second support member adapted to support the first saddlebag so that the pair of openings formed in the inner wall of the first saddlebag are aligned with the openings formed in the first and second ends of said first support member;

said fourth support member adapted to support the second saddlebag so that the pair of openings formed in the inner wall of the second saddlebag are aligned with the openings formed in the first and second ends of said third support member and a fastener extending outwardly through each of the openings in the inner walls of each of the saddlebags and through one of the openings in the first and second ends of said first and third support members to secure the saddlebags thereto.

8. The saddlebag wall hanger of claim 7 wherein a fastener retainer is positioned adjacent each of said openings in said first and second ends of said first and second support members.

9. The saddlebag wall hanger of claim 7 wherein a fastener retainer is positioned in each of said openings in said first and second ends of said first and second support members.

10. The saddlebag wall hanger of claim 7 wherein each of the fastener retainers are of the quick release type.

11. The saddlebag wall hanger of claim 7 wherein said second and fourth support members dwell in a vertical plane outwardly of the vertical plane of said first and third support members.

12. The saddlebag wall hanger of claim 7 wherein each of said second and fourth support members are selectively vertically adjustably secured to said first support.

13. The saddlebag wall hanger of claim 11 wherein each of said second and fourth support members are selectively movable between a saddlebag supporting position and a stowed position.

14. A motorcycle saddlebag hanger for supporting first and second saddlebags thereon in a vertically spaced-apart manner with each of the saddlebags having an inner wall with a pair of horizontally spaced-apart openings formed therein, comprising:

a vertically disposed first support having upper and lower ends;

a first elongated, horizontally disposed support member, intermediate its length, to said first support adjacent said upper end thereof;

said first support member having first and second ends;

a second elongated, horizontally disposed support member secured, intermediate its length, to said first support below said first support member so as to be vertically spaced from said first support member;

said second support member having first and second ends;

a third elongated, horizontally disposed support member secured, intermediate its length, to said first support below said second support member so as to be vertically spaced from said second support member;

said third support member having first and second ends;

a fourth elongated, horizontally disposed support member secured, intermediate its length, to said first support below said third support member so as to be vertically spaced from said third support member;

said fourth support member having first and second ends;

each of said first and second ends of said first and third support members having an opening formed therein;

said second support member adapted to support the first saddlebag so that the pair of openings formed in the inner wall of the first saddlebag are aligned with the openings formed in the first and second ends of said first support member;

said fourth support member adapted to support the second saddlebag so that the pair of openings formed in the inner wall of the second saddlebag are aligned with the openings formed in the first and second ends of said third support member; and a fastener extending outwardly through each of the openings in the inner walls of each of the saddlebags and through one of the openings in the first and second ends of said first and third support members to secure the saddlebags thereto.

15. The saddlebag wall hanger of claim 14 wherein a fastener retainer is positioned adjacent each of said openings in said first and second ends of said first and second support members.

16. The saddlebag wall hanger of claim 14 wherein a fastener retainer is positioned in each of said openings in said first and second ends of said first and second support members.

17. The saddlebag wall hanger of claim 15 wherein each of the fastener retainers are of the quick release type.

18. The saddlebag wall hanger of claim 15 wherein said second and fourth support members dwell in a vertical plane outwardly of the vertical plane of said first and third support members.

19. The saddlebag wall hanger of claim 15 wherein each of said second and fourth support members are selectively vertically adjustably secured to said first support.

20. The saddlebag wall hanger of claim 18 wherein each of said second and fourth support members are selectively movable between a saddlebag supporting position and a stowed position.

21. The saddlebag wall hanger of claim 1 wherein said first support is a two-piece support to provide first and second hanger units which may be secured to a wall in a side-by-side relationship.

22. The saddlebag wall hanger of claim 7 wherein said first support is a two-piece support to provide first and second hanger units which may be secured to a wall in a side-by-side relationship.

23. The saddlebag wall hanger of claim 14 wherein said first support is a two-piece support to provide first and second hanger units which may be secured to a wall in a side-by-side relationship.

24. A motorcycle saddlebag hanger for supporting first and second saddlebags thereon in a vertically spaced-apart manner or a horizontally spaced-apart manner with each of the saddlebags having an inner wall with a pair of horizontally spaced-apart openings formed therein, comprising:

a vertically disposed first support;

said first support being comprised of an upper support having upper and lower ends and a lower support having upper and lower ends;

a first elongated, horizontally disposed support member, intermediate its length, to said upper support adjacent said upper end thereof;

said first support member having first and second ends;

a second elongated, horizontally disposed support member secured, intermediate its length, to said upper support below said first support member so as to be vertically spaced from said first support member;

said second support member having first and second ends;

a third elongated, horizontally disposed support member secured, intermediate its length, to said lower support below the upper end thereof;

said third support member having first and second ends;

a fourth elongated, horizontally disposed support member secured, intermediate its length, to said lower support below said third support member so as to be vertically spaced from said third support member;

said fourth support member having first and second ends;

each of said first and second ends of said first and third support members having an opening formed therein;

said second support member adapted to support the first saddlebag so that the pair of openings formed in the inner wall of the first saddlebag are aligned with the openings formed in the first and second ends of said first support member;

said fourth support member adapted to support the second saddlebag so that the pair of openings formed in the inner wall of the second saddlebag are aligned with the openings formed in the first and second ends of said third support member; and a fastener extending outwardly through each of the openings in the inner walls of each of the saddlebags and through one of the openings in the first and second ends of said first and third support members to secure the saddlebags thereto;

said upper and lower supports of said first support being able to be positioned in an end-to-end relationship with respect to one another so that the saddlebags may be positioned thereon in a vertically spaced-apart manner;

said upper and lower supports of said first support being able to be positioned in a horizontally spaced-apart relationship so that the saddlebags may be positioned thereon in a horizontally spaced-apart manner.

* * * * *